United States Patent [19]

Chesneau et al.

[11] 4,001,833

[45] Jan. 4, 1977

[54] WHOLE WAVE VERTICAL ANTENNA

[75] Inventors: René Chesneau; Jean-Marc Martin, both of Paris, France

[73] Assignee: Thomson-CSF, Paris, France

[22] Filed: Oct. 3, 1975

[21] Appl. No.: 619,356

[30] Foreign Application Priority Data

Oct. 4, 1974 France ..... 74.33528

[52] U.S. Cl. ..... 343/747; 343/802; 343/875; 343/891

[51] Int. Cl.[2] ..... H01Q 9/34; H01Q 9/18

[58] Field of Search ..... 343/749, 750, 874, 875, 343/890, 891, 747, 802

[56] References Cited

UNITED STATES PATENTS

| | | | |
|---|---|---|---|
| 1,314,095 | 8/1919 | Reuthe | 343/750 |
| 1,967,881 | 7/1934 | Green | 343/749 |
| 2,163,743 | 6/1939 | Berndt | 343/875 |
| 2,204,026 | 6/1940 | Peters | 343/874 |

*Primary Examiner*—Eli Lieberman
*Attorney, Agent, or Firm*—Cushman, Darby & Cushman

[57] ABSTRACT

A whole wave antenna is placed on an insulating support and has its feed input located a little above its middle. In order to reduce secondary lobes inductive reactances are serially inserted in the antenna on each side of its feed input so as to produce a rapid rotation with inversion of the phase of the currents on each side of the feed input.

4 Claims, 5 Drawing Figures

WHOLE WAVE VERTICAL ANTENNA

The present invention relates to a whole wave vertical antenna.

Such antennas are employed in hectometric wave broadcasting.

These antennas have vertical radiation patterns having relatively large secondary lobes — which is disadvantageous owing to the interferences which may result.

An object of the present invention is to avoid this drawback.

According to the invention, there is provided a whole wave vertical antenna having a feed input, comprising two terminals, above and near its middle point, and comprising first and second inductive reactances, each having two terminals, serially inserted in said antenna, respectively above and below said feed input, for producing a rapid rotation with inversion of the phase of the currents on each side of said feed input.

The invention will be understood better, and other of its features will be apparent from the ensuing description with reference to the accompanying drawing in which.

In these figures, corresponding elements are designated by the same references.

Figure 1:
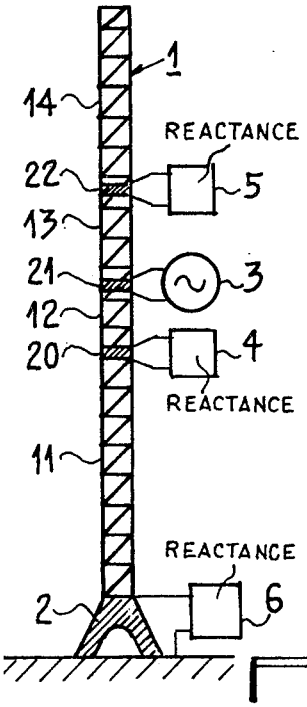
FIG. 1 shows an antenna according to the invention.

FIG. 1 shows a whole wave antenna 1 which is placed on an insulating support 2 bearing on the ground and is supplied substantially at its middle by a generator 3. This antenna, which forms a thin dipole, comprises four radiating parts 11 to 14 placed end-to-end and separated by insulators 20 to 22. The height of the antenna, theoretically equal to its operational wavelength λ, is in fact slightly less than this value in order to take into account the fact that the speed of propagation along the antenna is decreased by the non-negligible diameter of the latter.

Two reactances 4 and 5 are respectively inserted between the parts 11 and 12 and between the parts 13 and 14; their function will be explained with reference to FIGS. 2 and 3.

A reactance 6, which is not essential, connects the part 11 to the ground and its purpose is to perfect the tuning of the antenna.

The lengths of the parts 11, 12, 13, 14 are 0.42λ, 0.11λ, 0.16λ and 0.29λ respectively.

Figure 2:
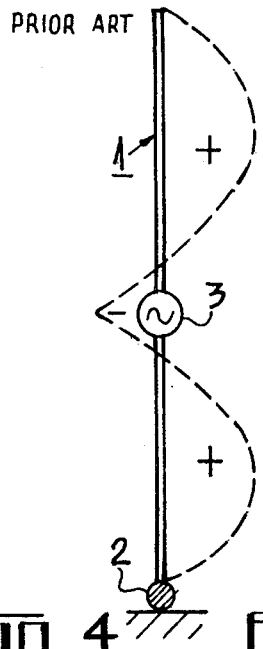
FIG. 2 is a diagrammatic representation of the distribution of the current phases on a whole wave vertical antenna according to the prior art.
Figure 3:
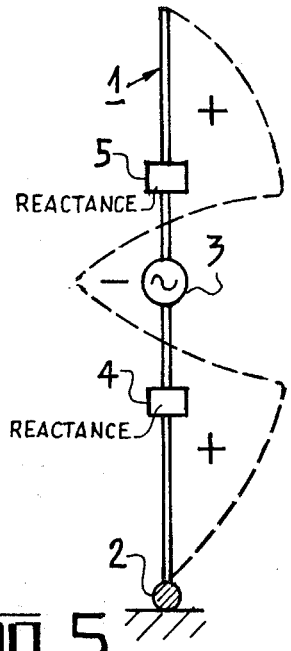
FIG. 3 is a diagrammatic representation of the distribution of the current phases on a whole wave vertical antenna according to the invention.

The fact that the antenna shown in FIG. 1 is constructed as indicated hereinbefore will be understood from FIGS. 2 and 3.

FIG. 2 shows a whole wave antenna 1 placed on an insulating support 2 and supplied, substantially at its middle, by a generator 3. The dotted line represents the conventional curve of current distribution along the antenna and determines with the antenna three regions designated +, −, +; in that portion of the antenna which is located around the feed input of the antenna and which determines with the curve of current distribution the region −, the sign of the phase is inverted relatively to that of the phase in the other two portions corresponding to the regions +. This antenna has a radiation pattern with relatively high level of secondary lobes.

Experience shows and theoretical considerations confirm, that, in order to reduce the secondary lobes of the vertical diagram of such an antenna, the distribution of the current must be modified so that the region − has a position and surface different from those of FIG. 2 and which correspond to a source placed a little above the middle of the antenna (about 0.55λ) and to a surface of the region − about one half of that of the other two regions +, this implies a rapid rotation with inversion of the phase of the currents on each side of the supply point. This is illustrated in FIG. 3 which shows an antenna which differs from the antenna shown in FIG. 2 by the insertion in the antenna on each side of the generator 3 of two inductive reactances 4, 5, the function of which is to accentuate the rotation of the current phase in the vicinity of the region in which the antenna is supplied by the generator 3.

Figure 4:
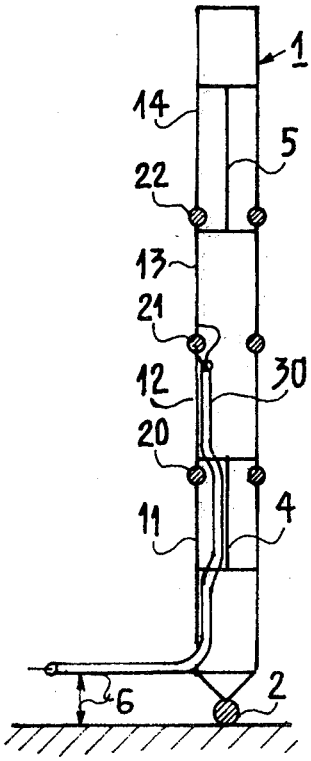
FIGS. 4 and 5 show two particular embodiments of an antenna according to the invention.

FIG. 4 is a diagrammatic sectional view of an embodiment of the antenna according to the invention in which the radiating parts 11 to 14 of an antenna 1 are formed by a pylon placed on an insulator 2 and divided into four radiating parts 11 to 14 separated by insulators 20 to 22. The phase-shifting reactances are provided by adjustable sections 4, 5 substantially ¼ wave long; the tuning reactance 6, which connects the radiating part 11 to the ground, is provided in the same way. The supply of this antenna at its middle is obtained by means of a supply cable 30 which extends along the sections 6 and 4 and reaches the middle of the antenna.

Figure 5:
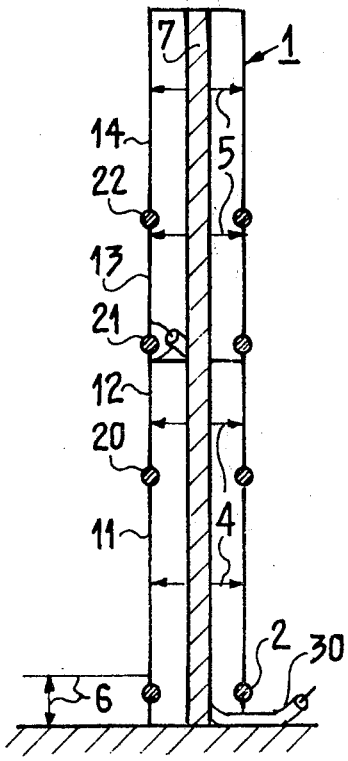

FIG. 5 is a diagrammatic sectional view of an embodiment of the antenna according to the invention in which a pylon 7 has merely to support the radiating parts 11 to 14 of an antenna 1. These radiating parts are formed by a cylindrical group of vertical, parallel wires. The wires are held taut between an insulator 2 fixed to the ground and the top of the pylon 7; they are divided at three different heights by insulators 20, 21, 22 so as to form radiating parts 11 to 14. Phase-shifting and tuning reactances 4, 5 and 6 are provided by short circuits displaceable in height. The supply of this antenna at its middle is provided by means of a supply cable 30 which extends along the pylon 7 and reaches the middle of the antenna.

No mention has been made in the foregoing of the fixing of the pylons, but it will be understood that these pylons may be self-supporting or supported by means of guys.

By way of modification of the embodiments described, the upper part 14 of these antennas may be shortened by the use of an end capacitor mounted at the top of the antenna.

With the antennas according to the invention it is possible to reduce the secondary lobes to a level of −20 dB from an angle of elevation of 30° to the zenith (90°).

An antenna according to the invention is in particular of utility in an array of antennas having a directional pattern in azimuth.

Of course, the invention is not limited to the embodiments described and shown which were given solely by way of example.

What is claimed is:

1. A whole wave vertical antenna having a feed input, comprising two terminals, above and near its middle point, and comprising first and second inductive reactances, each having two terminals, serially inserted in said antenna, respectively above and below said feed input, so as to determine, by means of an inversion of the phase of the currents on each side of said feed input, a curve of current distribution along the antenna delimiting with the axis thereof three successive regions of which the center one has a surface about one half of that of each of the other two.

2. A whole wave vertical antenna as claimed in claim 1, comprising a tuning reactance connected between its base and ground.

3. A whole wave vertical antenna as claimed in claim 1, comprising a support pylon forming the radiating part of said antenna and successive first, second and third insulators dividing said support pylon into sections; the two terminals of said first inductive reactance being connected to said pylon at two points thereof separated by said first insulator, the two terminals of said second inductive reactance being connected to said pylon at two points thereof separated by said third insulator and the two terminals of said feed input being connected to said pylon at two points thereof separated by said second insulator.

4. A whole wave vertical antenna as claimed in claim 1, comprising: a pylon, a first insulator fixed to the ground, a cylindrical group of vertical, parallel wires held taut between the top of said pylon and said first insulator and forming the radiating part of said antenna, successive second, third and fourth insulators dividing the wires of said group into four sections and four short-circuits displaceable in height for respectively short-circuiting said four sections; the two terminals of said feed input being connected to the wires of said group at two points thereof separated by said third insulator.

* * * * *